United States Patent [19]

Schuchert

[11] 4,201,901

[45] May 6, 1980

[54] ADJUSTABLE SAFETY INTERLOCK FOR MICROWAVE OVENS

[75] Inventor: Barton O. Schuchert, Iowa City, Iowa

[73] Assignee: Amana Refrigeration, Inc., Amana, Iowa

[21] Appl. No.: 888,201

[22] Filed: Mar. 20, 1978

[51] Int. Cl.[2] ..... H05B 9/06; H01H 3/16; E05C 13/10

[52] U.S. Cl. ..... 219/10.55 C; 200/153 T; 292/DIG. 69

[58] Field of Search ..... 219/10.55 B, 10.55 C; 200/153 T; 126/197; 292/DIG. 69; 335/42

[56] References Cited

U.S. PATENT DOCUMENTS

| | | | |
|---|---|---|---|
| Re. 28,249 | 11/1974 | Estrem | 200/153 T X |
| Re. 28,822 | 5/1976 | Fritts | 219/10.55 C X |
| B 549,964 | 2/1976 | Tippy et al. | 292/254 |
| 3,188,441 | 6/1965 | Ojelid | 219/10.55 |
| 3,496,316 | 2/1970 | Foerstner | 200/50 |
| 3,715,552 | 2/1973 | Umezu et al. | 219/10.55 |
| 3,815,064 | 6/1974 | Maier et al. | 352/42 X |

*Primary Examiner*—B. A. Reynolds
*Assistant Examiner*—Keith E. George
*Attorney, Agent, or Firm*—Robert W. Hoke, II

[57] ABSTRACT

An adjustable safety interlock is disclosed for microwave ovens or other high voltage electrical apparatus. The interlock is actuated by the movement of a counterbalance arm when the door is opened. The amount of movement necessary to actuate the interlock is altered by changing the position of the interlock switch relative to the counterbalance arm. The interlock switch is pivotally mounted on the side of the apparatus for this purpose. Pivotal movement of the interlock towards and away from the counterbalance arm is achieved by a finely threaded bolt. The bolt is biased in the direction of greater safety by a compression spring. The interlock is readily accessible during production and thereafter only by authorized personnel.

4 Claims, 8 Drawing Figures

ADJUSTABLE SAFETY INTERLOCK FOR MICROWAVE OVENS

BACKGROUND OF THE INVENTION

The invention relates to electrical apparatus and more particularly to an adjustable interlock for safe operation of microwave ovens.

The source of microwave energy utilized in microwave ovens is the magnetron which is now well known in the art. Such magnetron generators provide for radiation of energy within an enclosure to heat any food article disposed therein. Magnetron energy generators conventionally operate from regular line sources of low frequency and low voltage which is stepped up to DC rectified voltages of 4,000 to 6,000 volts. To provide for safe operation, interlock switches have evolved in the prior art to interrupt the line power and prevent radiation of energy except when the door to the enclosure is closed. Such interlock switches prevent serious damage to the expensive equipment and are intended, with associated electrical circuitry, to substantially reduce any hazards associated with the high voltage supplies. A concern about such devices has been the possibility of radiation leakage which might result in injury to the operator. Because of this concern, the Department of Health, Education and Welfare, through the Bureau of Radiological Health (BRH), has promulgated a series of regulations specifying minimum safety precautions for microwave ovens manufactured or sold in the United States.

All such ovens are required to have a minimum of two safety interlocks. At least one safety interlock must be concealed, and the concealed interlock must not be operable by any part of the human body, any object with a straight insertable length of ten (10) centimeters, or a test magnet held in place on the oven by gravity or its own attraction.

It is further required that any visible actuating member of the concealed safety interlock must not be intended for removal by conventional tools without full or partial disassembly of the door. It must also have an apparent useful purpose and function other than interlock actuation unless access to the interlock is prevented when the door is open. Finally it is required that a means of monitoring at least one of the safety interlocks be provided to cause the oven to become inoperable if the safety interlock should fail.

Since the interlock switches are required to open and close each time the apparatus is operated, such devices must be completely reliable and adequately disable the electrical circuits at any time that a potentially hazardous condition arises. Mass production techniques compound the difficulty in attaining a truly reliable safety interlock. Assembly line manufacturing makes it necessary that the interlock be economical to produce, easy to install, convenient to adjust and consistently reliable from oven to oven. But most important, the adjustment must be precise. The accuracy of the setting cannot be compromised for ease of production.

SUMMARY OF THE INVENTION

According to this invention, in a high frequency heating apparatus of the class comprising a cabinet defining therein a heating chamber with an access opening, a door closing the access opening, a magnetron for radiating high frequency electromagnetic waves in the heating chamber, and a timer for presetting the operating time of the magnetron, there is provided an adjustable interlock switch mechanism which will positively operate each time the oven door is opened to stop operation of the magnetron.

The primary objective of the invention is to provide an interlock which can be easily and accurately adjusted in assembly line production and thereafter is only accessible to authorized service personnel.

Another object of the invention is to provide a fail-safe device such that any shift in the set point of the interlock can only be in the direction of greater safety.

A further object of the invention is to provide an interlock which has relatively few total parts and a minimum of moving parts so that it is economical to produce and highly durable in use.

Another object is to make the interlock adjustment extremely precise to minimize possible radiation leakage at the instant the door is jarred or otherwise moved a predetermined distance from the closed position.

Other objects and advantages of the invention will become apparent from the following description, the accompanying drawings and the appended claims.

DESCRIPTION OF THE PREFERRED EMBODIMENT

Figure 1:
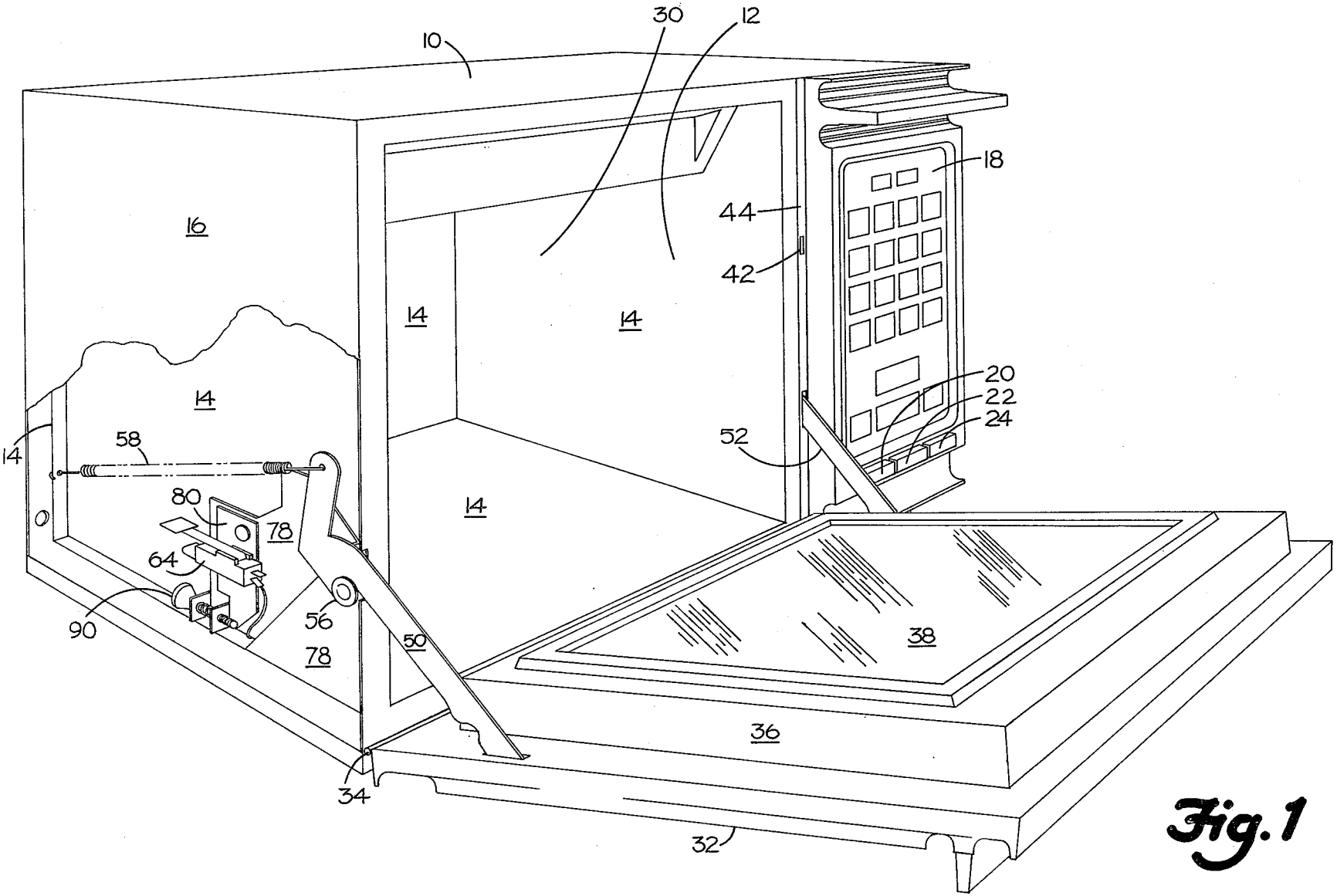
FIG. 1 is a perspective view of a microwave oven with portions broken away to illustrate an interlock mechanism positioned along the left side of the oven wall.
Figure 2:
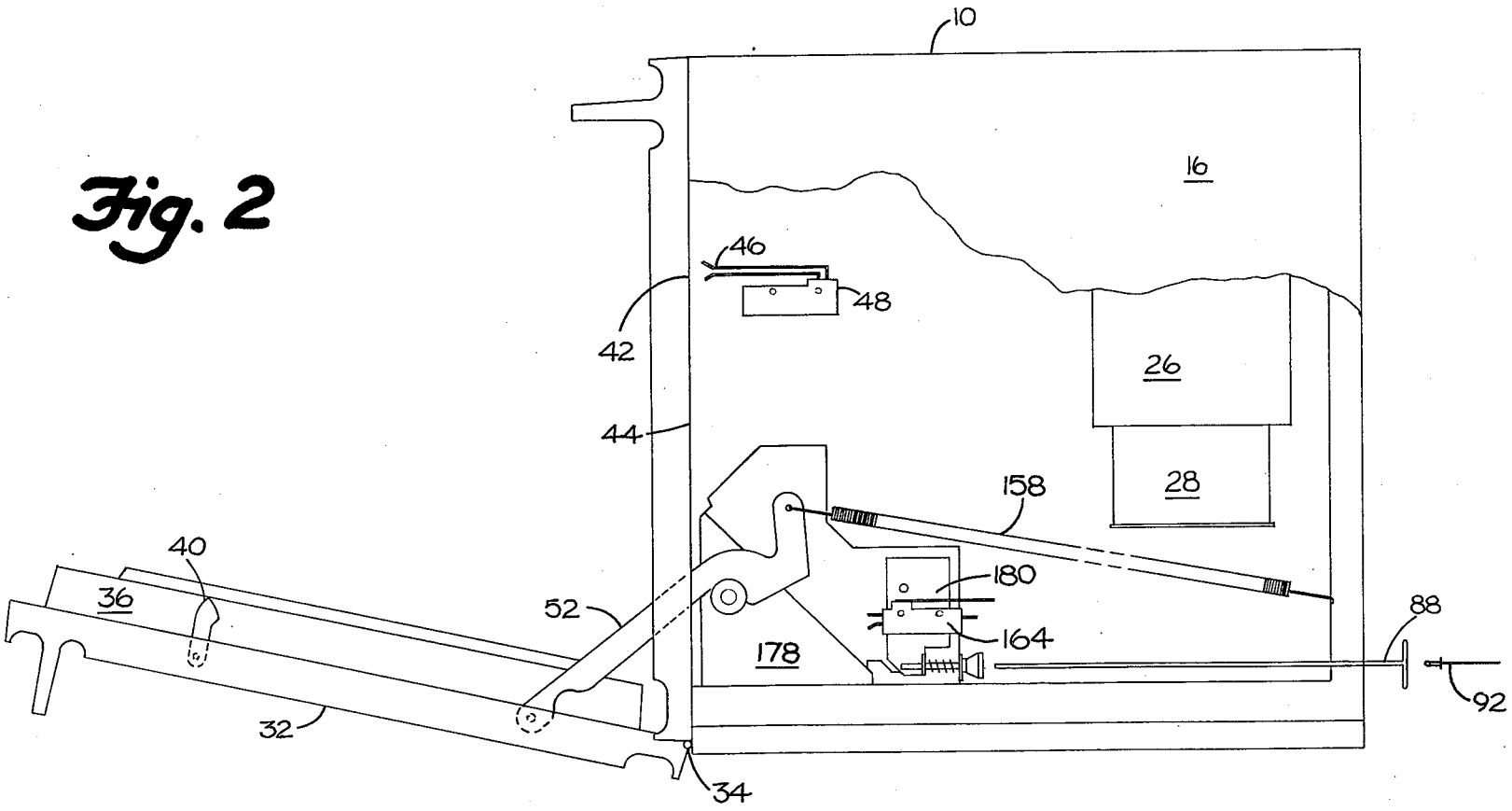
FIG. 2 is a side view of a microwave oven with portions broken away to illustrate an interlock mechanism positioned along the right side of the oven wall.

FIG. 1 and FIG. 2 show a microwave oven 10 from the left and right sides, respectively. A hollow cavity enclosure 12 is defined by conductive walls 14. The dimensions of the enclosure are selected to excite numerous modes of microwave energy at desirably a frequency of 2,450 MHz, one of the alotted frequencies for such devices. Case 16 surrounds the oven enclosure as well as the high voltage electrical circuits, controls and microwave energy source. Control panel 18 contains means for selecting defrost time, cooking time, power levels and the like. Control panel 18 is the subject of U.S. Pat. No. 4,011,428, issued Mar. 8, 1977, and is incorporated herein by reference. Control buttons 20, 22, and 24 provide for, respectively, start, stop and light control.

The source of electromagnetic energy is the magnetron 26 and its accompanying high voltage electrical circuits, denoted by block 28. Both of these are now considered to be well known in the art and representative electrical circuits are more particularly described in U.S. Pat. No. RE 28,822, incorporated herein by reference.

Access to the oven cavity 12 is provided by opening 30. The opening is closed by the door assembly 32 which has been illustrated of the drop-down type with a bottom hinge 34. The door assembly 32 has an inner cover 36 with a window 38 of a high dielectric loss material to provide secondary energy absorbing means for any radiated energy escaping around the periphery of the opening.

Latch 40 is mounted on the door assembly and engages a mating slot 42 in a peripheral front wall 44 surrounding the access opening 30. A mechanically actuated latch locking arrangement 46 is slideably disposed within the peripheral front wall 44. An interlock switch 48 is controlled by latch 40 to break the circuit upon any opening of the door assembly while the oven is operating. Movement of the drop-down type door assembly 32 is controlled by a pair of spring-tensioned, left and right counterbalance arms 50 and 52, respectively. Tension spring 58 works in conjunction with arm 50, and tension spring 158 works in conjunction with arm 52.

Figure 4:
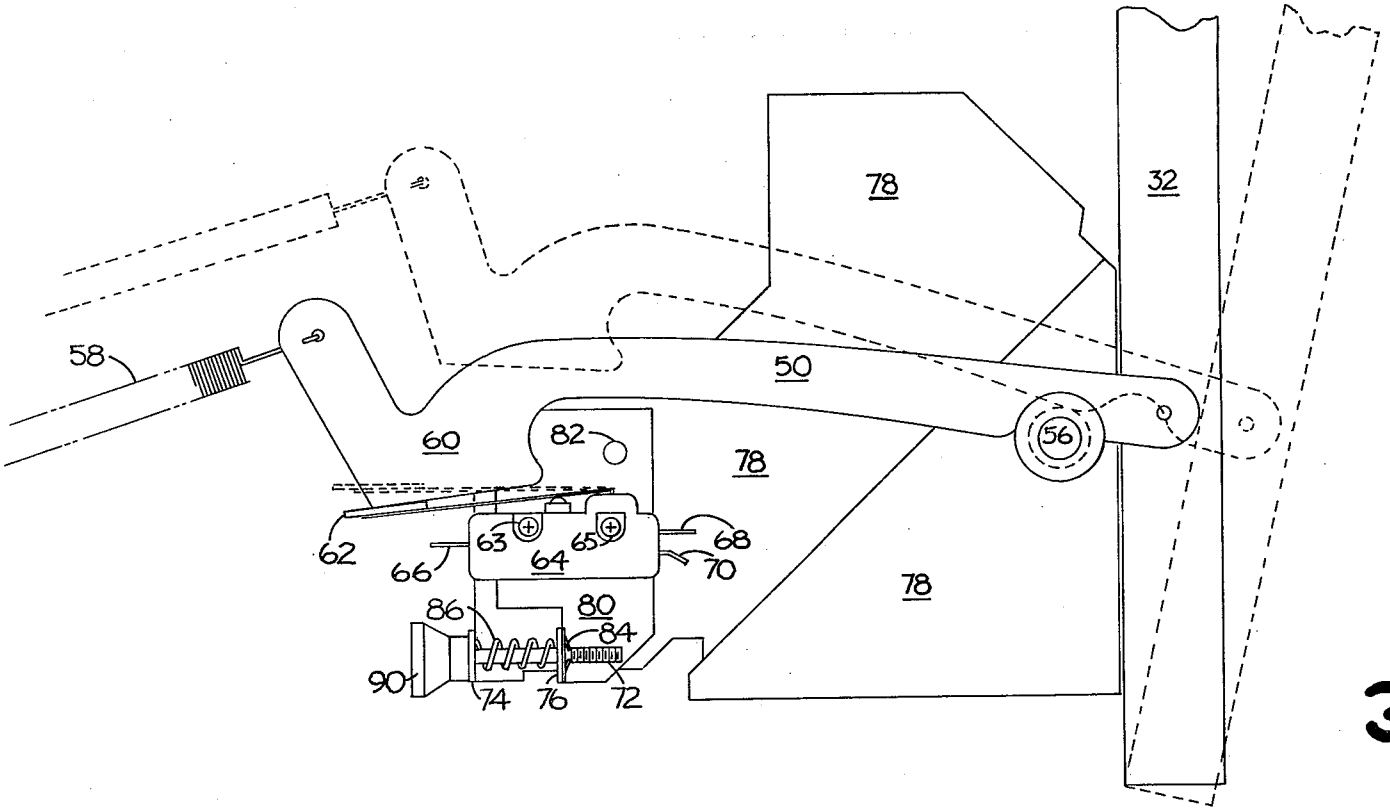
FIG. 4 is a side view of the left interlock mechanism showing its operation.

In FIG. 1 and FIG. 4, the movement of the left counterbalance arm 50 is depicted. The dotted line portion in FIG. 4 illustrates the relative position of the moving parts when the door assembly 32 is partially opened. Arm 50 is pivotally mounted on the side of the door assembly 32. A bearing member 56 of low-friction, long-wearing material, such as nylon, provides a riding surface for the arm. One end of spring 58 is attached to the inner end of arm 50. The other end is attached to the conductive wall 14' of the oven to provide the appropriate tensioning as the door is opened and closed.

Figure 7:
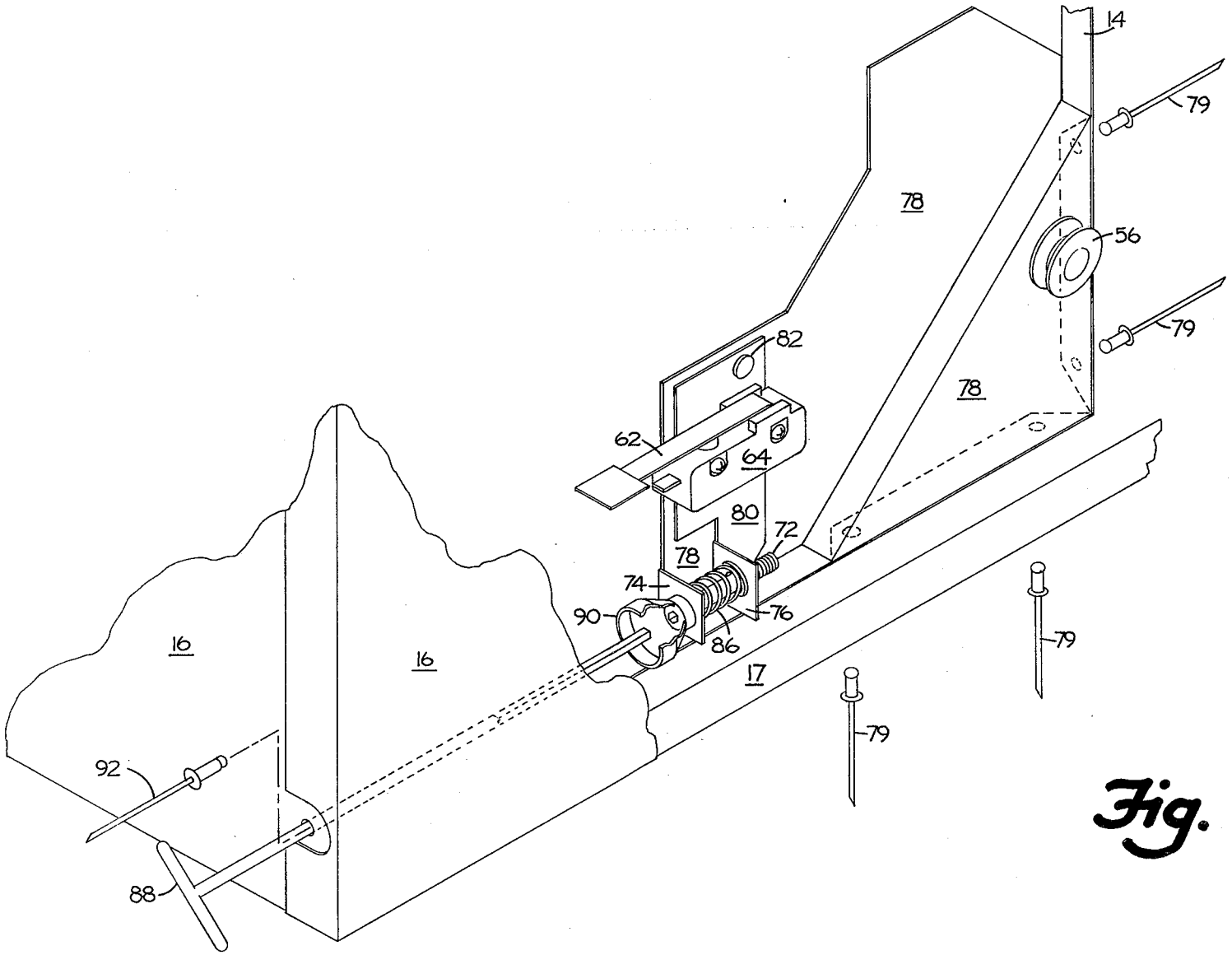
FIG. 7 is a perspective view of the rear of a microwave oven with portions broken away to illustrate adjustment of the left interlock mechanism.

FIG. 4 and FIG. 7 illustrate the parts of the safety interlock operating in conjunction with the left counterbalance arm 50. Arm 50 has a hook-shaped portion 60 which, when the door is completely closed, engages and depresses lever arm 62 to close the interlock switch 64. Terminal connectors 66, 68, and 70 connect the door interlock switch to the appropriate electrical circuit for operation of the microwave oven. The electrical circuit is further described herein in conjunction with FIG. 8.

Interlock switch 64 is mounted on interlock bracket 80 by means of two screws 63 and 65. The interlock bracket 80 is pivotally mounted on counterbalance arm bracket 78 with a press-fit rivet 82. This allows the interlock bracket 80 to be rotated clockwise or counterclockwise on bracket 78 about rivet 82. Bracket 78 is attached to the conductive wall 14 by means of rivets 79.

Brackets 78 and 80 are formed out of a heavy-gauge sheet metal. One portion of counterbalance arm bracket 78 is bent perpendicular to the vertical plane to form tab 74. Likewise, one portion of interlock bracket 80 is bent perpendicular to the vertical plane to form tab 76.

Adjustment of the interlock is accomplished by turning the adjusting bolt 72. The adjusting bolt is mounted on tabs 74 and 76 which, in turn, are connected to the counterbalance arm bracket 78 and the interlock bracket 80, respectively. Bolt 72 is held in tab 76 by speed nut 84. As bolt 72 is turned, it moves the interlock bracket 80 about the pivot point, rivet 82. This movement, in turn, changes the distance between lever arm 62 and the counterbalance arm 50. The hole in tab 76 is oversized to allow bracket 80 to pivot without moving screw 72 from its horizontal position as shown in FIG. 1.

Figure 6:
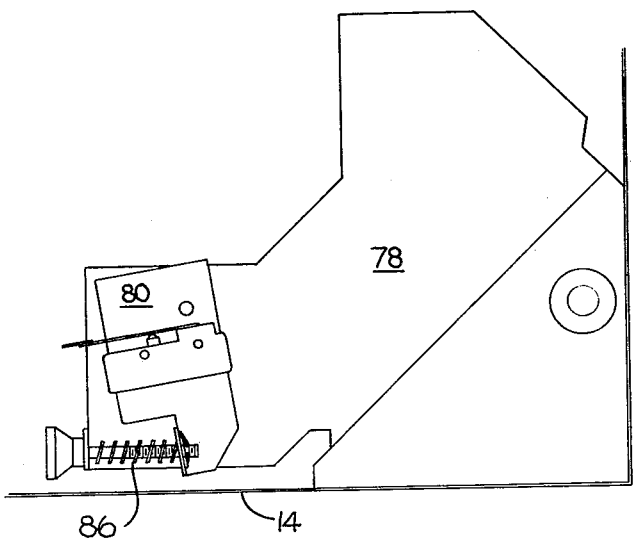
FIG. 6 is a side view of the left interlock mechanism adjusted fully counterclockwise.
Figure 5:
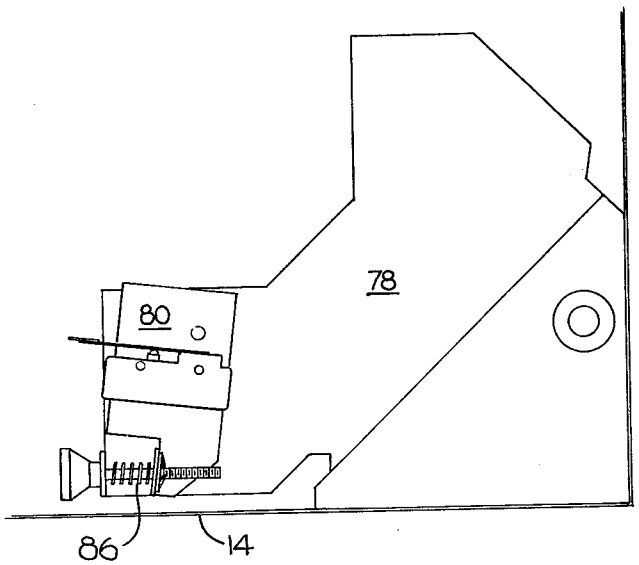
FIG. 5 is a side view of the left interlock mechanism adjusted fully clockwise.

The movement of bracket 80 relative to bracket 78 and conductive walls 14 is shown more fully in FIG. 5 and FIG. 6. In FIG. 5, interlock bracket 80 is rotated fully clockwise. In FIG. 6, interlock bracket 80 is rotated fully counterclockwise.

As shown in FIG. 4, bolt 72 is finely threaded to increase the frictional resistance to reduce the likelihood of any change in its set point ever occurring. Tabs 74 and 76 are constantly being forced apart by compression spring 86. The purpose of the spring is to make the interlock failsafe. Because of the bias caused by spring 86, any unintentional change in the set point must be in the direction of greater safety. As the tabs are pushed further apart, bracket 80 rotates counterclockwise causing lever arm 62 to move away from counterbalance arm 50.

The combination of compression spring 86 and finely threaded bolt 72 makes the adjustment extremely precise. The interlock can be accurately set to interrupt the input current to the magnetron when the door is opened a predetermined distance from the closed position. The importance of such exact operation lies in the strict standards set by the Bureau of Radiological Health. If operation of the magnetron is not always cut off before the door is opened a predetermind distance, the microwave oven may not be sold to the public.

FIG. 7 shows how the interlock switch is physically adjusted after the oven is assembled and the outer case 16 is put on. Bolt 72 has a hexagonal depression in its head. An adjusting tool 88 with a matching hexagonal head is slid through an aperture in case 16 and conductive wall 14' and engaged with bolt 72. It is guided by the plastic bolt head 90. After the interlock is properly adjusted, the hole in the case is closed with a pop rivet 92. The purpose of the rivet is to prevent adjustment by unauthorized personnel. It must be drilled out later if the interlock is to be readjusted. This is easier and safer than removing the outer case.

Figure 3:
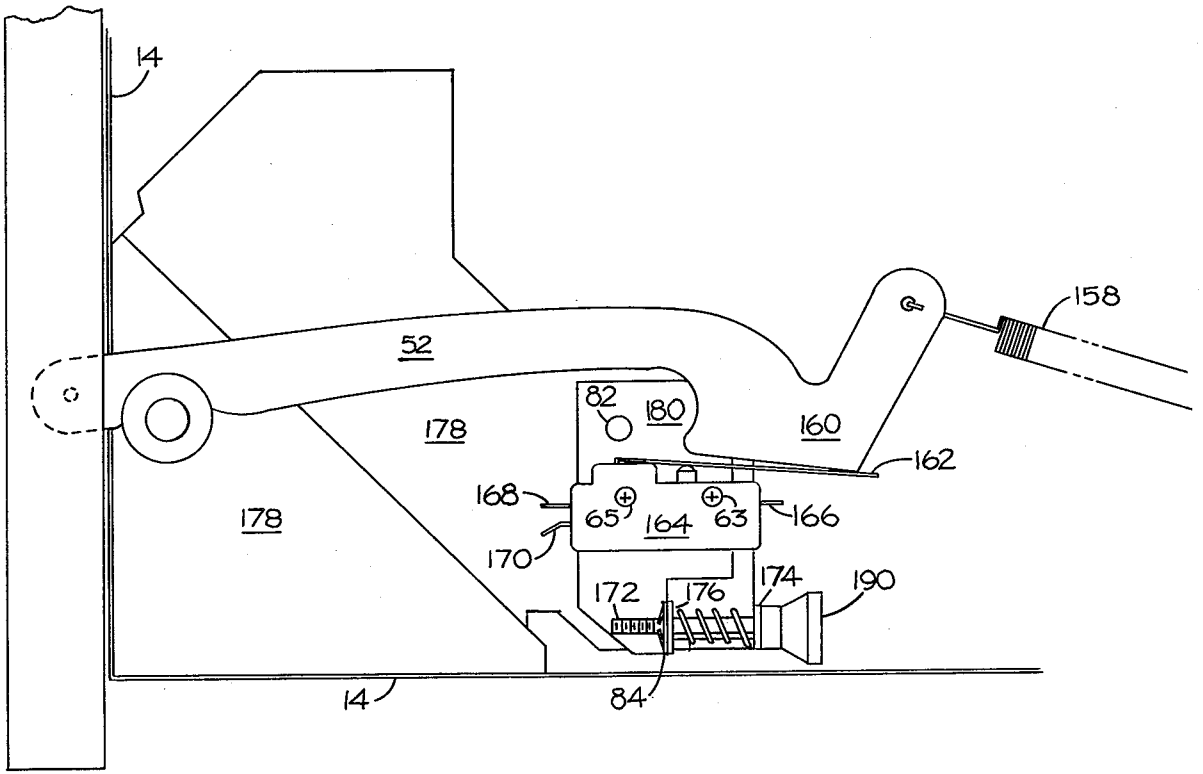
FIG. 3 is a side view of the right interlock mechanism.

FIG. 2 and FIG. 3 illustrate the parts of a similar safety interlock operating in conjunction with the right counterbalance arm 52. Arm 52 has a hook-shaped portion 160 which, when the door is completely closed, engages and depresses lever arm 162 to open the interlock switch 164. Terminal connectors 166, 168, and 170 connect the door interlock switch to the appropriate electrical circuit for operation of the microwave oven.

Interlock switch 164 is mounted on interlock bracket 180 by means of two screws 63 and 65. The interlock bracket 180 is pivotally mounted on counterbalance arm bracket 178 with a press-fit rivet 82. This allows the interlock bracket 180 to be rotated clockwise or counterclockwise on bracket 178 about rivet 82. Bracket 178 is attached to the conductive wall 14 by means of rivets (not shown).

Brackets 178 and 180 are formed out of a heavy-gauge sheet metal. One portion of counterbalance arm bracket 178 is bent perpendicular to the vertical plane to form tab 174. Likewise, one portion of interlock bracket 180 is bent perpendicular to the vertical plane to form tab 176.

Adjustment of the right interlock is accomplished in the same manner as the left interlock by turning and adjusting bolt 172 with tool 88 in plastic bolt head 190. The adjusting bolt is mounted on tabs 174 and 176 which, in turn, are connected to the counterbalance arm bracket 178 and the interlock bracket 180, respectively. Bolt 172 is held in tab 176 by speed nut 84. As bolt 172 is turned, it moves the interlock bracket 180 about the pivot point, rivet 82. The hole in tab 176 is oversized to allow bracket 180 to pivot without moving screw 172 from its horizontal position as shown in FIG. 2. After the interlock is properly adjusted, the hole in case 16 is closed with a pop rivet 92.

Figure 8:
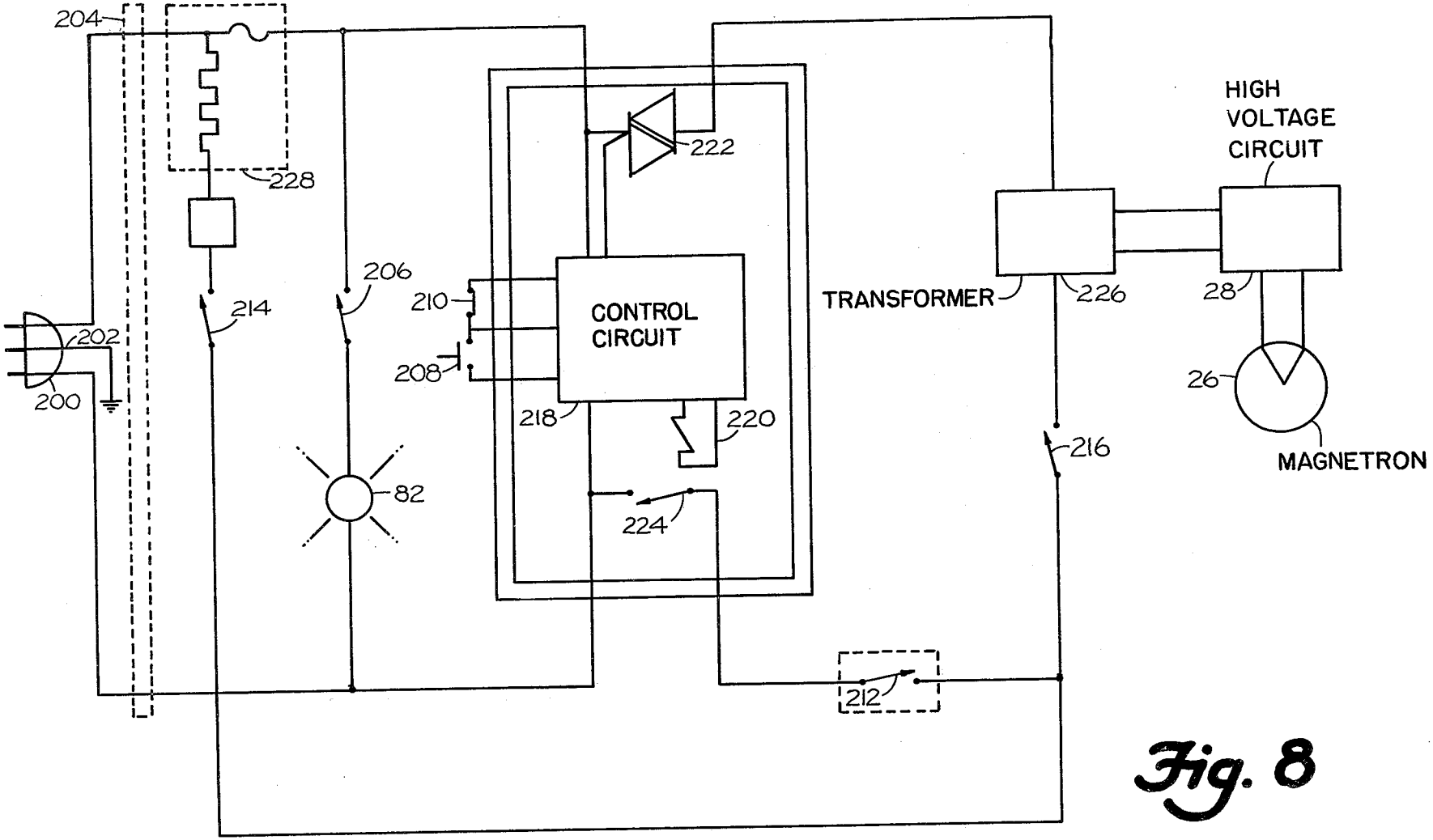
FIG. 8 is a block diagram of a microwave oven electrical circuit employing the invention.

FIG. 8 is a block diagram of an electrical circuit for a microwave oven incorporating the safety interlock. A conventional three-terminal connector 200 having a grounded lead 202 is connected to the conventional domestic or industrial line voltage source. A terminal board 204 interconnects all of the components to the line voltages. Previously described light button 24 actuates light switch 206 to illuminate the interior of the oven enclosure. In a like manner, start button 20 and stop button 22 actuate start switch 208 and stop switch 210, respectively. Interlock switch 64, described above, actuates switch 212. Right interlock switch 164 activates switch 214, and latch interlock switch 48 actuates switch 216.

When the oven door is open, switches 212 and 216 are open and switch 214 is closed. When the oven door is closed, the left interlock switch 64 closes switch 212, the latch interlock switch 48 closes switch 216, and the right interlock switch 164 opens switch 214. This prepares the oven circuitry for normal operation. When start button 20 is depressed, closing switch 208, current is supplied to the control circuit 218. The control circuit 218, like the control panel 18 referenced above, is the subject of U.S. Pat. No. 4,011,428, issued Mar. 8, 1977, and is incorporated herein by reference. Control circuit 218 energizes power relay coil 220 and pulses the gate circuit of triac 222. Relay coil 220, in turn, closes relay 224. This allows current to flow from the line source, through switches 212 and 216, and to transformer 226. Transformer 226 powers the high voltage electrical circuits 28 which power the magnetron 26.

If for any reason switch 212 should fail to open upon opening the oven door, current flows through switch 214 and to the thermal limiter 228. Switch 214 is normally closed when the door is open, as noted above. At a predetermined temperature, the thermal limiter 228 disintegrates and interrupts the line current, thereby cutting power to the magnetron 26. The thermal limiter is more particularly described in U.S. Pat. No. RE 28,822, incorporated herein by reference.

There is thus disclosed, an interlock mechanism that is readily accessible during production and thereafter only by authorized service personnel. Numerous modifications will be evident to those skilled in the art. The foregoing description of a preferred embodiment is, therefore, intended to be interpreted broadly.

What is claimed is:

1. A microwave oven apparatus, comprising:

(a) a cavity having walls defining a cooking enclosure and having an access opening;

(b) an outer case disposed about a portion of the cavity;

(c) a door for closing the access opening;

(d) a microwave energy source adapted to radiate energy within the enclosure;

(e) an electrical circuit for energizing the source and controlling the operation of the apparatus;

(f) a switch for interrupting the electrical circuit and de-energizing the microwave energy source;

(g) means for activating the switch upon closure of the door, wherein the activation means comprises a longitudinal member having its forward end connected to the door and a portion of its distal end disposed to contact the switch upon closure of the door, and a tension spring attached at one end of the distal end of the longitudinal member and at the other end to one of the cavity walls to urge the distal end into contact with the switch;

(h) means for supporting the switch disposed between the cavity and the outer case so that relative movement between the swich and the activation means is permitted, wherein the support means comprises a first support bracket mounted on one of the cavity walls, and a second support bracket pivotally attached to the first support bracket on which the switch is mounted in a fixed position;

(i) means for moving the switch relative to the activation means and for securing the switch in a selected position, wherein the movement means comprises:

a first tab formed from the first support bracket and having a hole therein, a second tab formed from the second support bracket and having a hole therein, an adjusting bolt that slides through the holes in the tabs, and means for retaining the bolt in the first tab;

a compression spring having one end pushing against the first tab and the other end pushing against the second tab to bias the switch means away from the activation means, whereby the contacting of the switch with the distal end of the longitudinal member is determined by the combination of the tension spring bias in conjunction with the longitudinal member, the compression spring bias between the first and second tabs, and the bias of the adjusting bolt; and (j) means for gaining access to the means for moving the switch after the outer case is positioned about the cavity, and means for closing the means for gaining access, wherein the means for gaining access comprises:

a hole in the outer case, and a first wall extending beyond a second, abutting cavity wall and having a hole therein that is axially aligned with the hole in the outer case and said adjusting bolt.

2. A microwave oven apparatus as recited in claim 1 wherein the means for closing the means for gaining access is a pop rivet for sealing the access hole in the outer case to prevent operation of the movement means.

3. A microwave oven apparatus as recited in claim 1 further comprising means for operating the movement means when the outer case is disposed about the cavity, and bolt head means for guiding the operating means into contact with the adjusting bolt.

4. A microwave oven apparatus as recited in claim 1 further comprising a bearing member disposed on the exterior side of one of the cavity walls to support the longitudinal member.

* * * * *